United States Patent [19]

Hintsch et al.

[11] 4,120,329

[45] Oct. 17, 1978

[54] GRIPPER SHUTTLE FOR PICKING IN WEAVING MACHINES

[75] Inventors: Otto Hintsch, Wallisellen, Switzerland; Rudolf Stauner, Konstanz, Germany

[73] Assignee: Sulzer Brothers Limited, Winterthur, Switzerland

[21] Appl. No.: 826,233

[22] Filed: Aug. 19, 1977

[30] Foreign Application Priority Data

Aug. 24, 1976 [CH] Switzerland ..... 10712/76

[51] Int. Cl.[2] ..... D03J 5/06

[52] U.S. Cl. ..... 139/196.2

[58] Field of Search ..... 139/196.1, 196.2, 438, 139/439, 196.3

[56] References Cited

U.S. PATENT DOCUMENTS

| | | | |
|---|---|---|---|
| 3,853,152 | 12/1974 | Pfarrwaller | 139/196.2 |
| 3,854,506 | 12/1974 | Pfarrwaller | 139/196.2 |
| 3,939,878 | 2/1976 | Pfarrwaller | 139/196.2 |

*Primary Examiner*—Henry S. Jaudon

*Attorney, Agent, or Firm*—Kenyon & Kenyon Reilly, Carr & Chapin

[57] ABSTRACT

The gripper shuttle is constructed of three parts, namely, a metal inner part, a plastics sleeve disposed about the metal inner part, and a yarn clamp having resilient arms within the inner part for engaging a yarn. The metal inner part may be formed with an I-beam cross section or may be of a rectangular cross section with or without a strengthening partition. The metal inner part lends strength to the shuttle, particularly for braking purposes while the plastics sleeve provides a sliding surface for picking.

25 Claims, 14 Drawing Figures

Fig.13
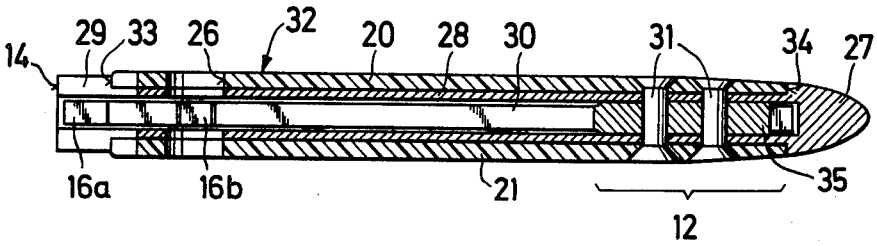
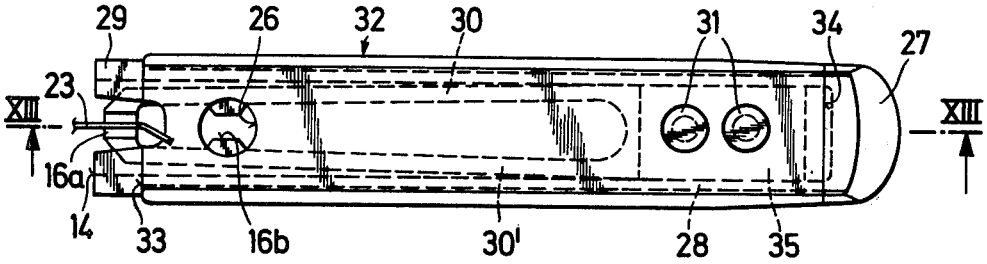
Fig. 14

GRIPPER SHUTTLE FOR PICKING IN WEAVING MACHINES

This invention relates to a gripper shuttle and particularly to a gripper shuttle for picking in a weaving machine.

As is known, various types of gripper shuttles or projectiles have been used for picking in weaving machines. In many cases, these shuttles have been used where a weft supply bobbin is positioned outside of a shed. Generally, these shuttles include a sleeve-like casing and a yarn clamp housed within the casing; the yarn clamp having two resilient arms which extend towards a rear open end of the casing in order to grip a yarn. One such shuttle is described in Swiss Pat. No. 571,086 and U.S. Pat. No. 3,339,818. In this case, the front end of the yarn clamp is provided with a yoke which is thickened to form a nose closing the front end of the casing. In another case, such as described in Swiss Pat. No. 466,829, the shuttle casing is made of a light impact-resistant plastics, such as polyethylene or tetrafluoroethylene, which can be reinforced with glass fibers and/or permeated with fine glass balls in order to insure that the casing surface has the required strength, resilience and sliding properties, and to reduce the weight of the shuttle.

Generally, the sleeve-like casing is provided as a replaceable wear element. In such cases, after wear, the casing can be removed and replaced by a new casing while the yarn clamp continues to be used.

One very advantageous construction of a known shuttle casing incorporates a feature disclosed, for example, in Swiss Pat. No. 552,092 U.S. Pat. No. 3,854,506. In this case, the plastics casing is stiffened by a web-like support wall which extends lengthwise inside the casing in the space between the two arms of the yarn clamp. This feature considerably improves the behavior of the shuttle upon entry into a catcher brake as compared with a shuttle having a purely tubular plastics casing. The feature also increases the service life of the casing to several million picks. However, after prolonged operation, the casing becomes permanently distorted and requires replacement before participating in the number of picks normally considered possible with the previously known steel projectile casings, for example, of the kind disclosed in Swiss Pat. No. 317,845. Generally, the unwanted distortions occur in two zones, namely, at the back end of the casing where the casing is struck by the picking stick during picking, and on the wide sidewalls of the casing which are increasingly pressed together in the course of time, despite the presence of a supporting or bearing wall therebetween, due to the repeated operation of a catcher brake. In this latter case, braking eventually becomes impaired.

Another disadvantage which causes premature impairment of the reliability of plastics shuttles such as described in Swiss Pat. No. 466,829 arises from the fact that the nose element cross section, considered in a direction perpendicular to the shuttle flight direction, has the same dimensions as the actual shuttle casing. Since the plastics material creeps, however slightly, after prolonged operation, either a small gap or a bead-like bulging of the plastics surface can arise at the junction between the steel nose element and the casing surface. As a result, warp yarns or yarn detectors may catch in the gap or bulging and become damaged depending upon other operating conditions such as heavy or light weft yarn, picking sequence and speed, adjustment of catcher brake or the like. Another disadvantage of this type of shuttle is that fine metal abrasion can be produced as a result of a direct contact of the metal projectile nose with the various guide teeth in the shuttle path and with the catcher brake when entering the catcher. These fine metal abrasions can cause soiling of a cloth being woven. Another disadvantage is that the yarn clamp may be subjected to unwanted vibrations with the result that the number of lost yarns for a given clamping force increases.

These disadvantages can be obviated to some extent by the features disclosed in Swiss Pat. Nos. 553,868 and 571,086 and U.S. Pat. No. 3,853,152 whereby the cross section of the metal nose of the shuttle can be made smaller all around than the cross section of the plastics casing. This completely obviates any direct contact between the metal parts of the shuttle and the guide teeth and brake shoes of the catcher.

Accordingly, it is an object of this invention to obviate the disadvantages of known shuttle constructions without losing the advantages of these shuttle constructions.

It is another object of the invention to provide a gripper shuttle which can be used for weaving heavy yarns in large weaving widths.

It is another object of the invention to provide a gripper shuttle having conventional external dimensions for weaving heavy yarns in large weaving widths.

It is another object of the invention to appreciably increase the dimensional stability of a gripper shuttle while retaining good sliding properties and vibration-damping effects.

It is another object of the invention to provide a gripper shuttle capable of a relatively long service life.

Briefly, the invention provides a gripper shuttle for picking in a weaving machine which is comprised of a metal inner part, a plastics sleeve disposed about the metal inner part and a yarn clamp having a pair of resilient arms disposed within the inner part for engaging a yarn. The plastics sleeve is provided with a pair of opposed sidewalls which bear on the inner part and a pair of opposed narrow sidewalls. In addition, the wide sidewalls have outer sliding surfaces for sliding on a series of guide teeth during picking and for engagement by a catcher during braking.

The gripper shuttle is of conventional external dimensions and appearance as compared with known gripper shuttles. Since the plastics rubbing or sliding surfaces are carried by the metal inner part, the dimensional integrity of the shuttle remains unaltered during a prolonged service life. Further, there is no impairment of the sliding properties of the plastics surfaces. The shuttle weight can be varied as required, according to the construction chosen, in dependence upon the proportion of metal members.

In a first embodiment, the metal inner part is in the form of a bar or rod of I-shaped cross section with a web extending longitudinally of the plastics sleeve between the resilient arms of the yarn clamp. In this case, the two wide sidewalls of the plastics sleeve are carried and stiffened relative to one another over their whole width by the top and bottom flanges of the inner part.

In another embodiment, the inner part is in the form of a tubular sleeve of rectangular cross section with the resilient arms of the yarn clamp disposed therein. In this case, a single web is replaced to some extent by two narrow sidewalls of the inner part. As a rule, this construction is heavier than the I-shaped construction. If it is required to further increase the weight of the shuttle and to provide further stiffening of the sleeve, the tubular inner part can be provided with a partition which extends longitudinally of and between the resilient arms of the clamp.

Depending on which form of construction is used, the nose of the shuttle can be formed either by the front end of the clamp or by the front end of the inner part. In the first case, the yarn clamp has a yoke which interconnects the resilient arms and forms a nose which projects from a forward end of the plastics sleeve. In this case, the yarn clamp is introduced into the plastics sleeve from the front and is secured therein. In the second case, the inner part projects from the forward end of the plastics sleeve to form the nose. In this case, the clamp is first secured in the inner part and thereafter the plastics sleeve is extruded around the inner part or is shrunk on in known manner.

Where the yarn clamp has a yoke forming a nose, a weld seam can be used to secure the nose and the metal inner part together. Such a seam can be produced, for example, by electronic welding similar to the manner described in Swiss Pat. No. 527,305 for assembling an all-metal shuttle.

In order to strengthen the tail or rear end of the shuttle, that is, the part of the shuttle which is struck by a picking stick in order to pick the shuttle, the metal inner part can be extended to the tail end or struck surface. In this case, the plastics sleeve can either extend as far as the tail end to obviate creep of the plastics, or may terminate at a distance from the tail end. Thus, all or some of the force transmitted during picking is transmitted by way of the metal inner part. This results in a considerable reduction in mechanical stressing of the plastics sleeve particularly since the contribution of the sleeve to the total shuttle weight is small.

As a rule, an adequate connection can be provided between the inner part and the plastics sleeve if the sleeve is press fit on the inner part. This is the case when the plastics sleeve is a shrunk fit on the inner part or takes the form of an extrusion which is produced by extruding around the inner part. In addition, a plurality of respective mating projections and recesses can be provided in the inner part and sleeve for interlocking the inner part and sleeve together. In this way, a kind of toothed or keyed engagement is formed between the inner part and sleeve. This engagement strengthens the press fit and obviates gradual lengthwise creep of the plastics sleeve on the inner part. Because of the resilience of the sleeve, the matching thickened and recessed parts snap into one another during original assembly or in the event of any incipient displacement.

In the case where the inner part has a nose projecting from the forward end of the sleeve and a tail which projects from the rear end of the sleeve, the intermediate part between the nose and tail is made of a wall thickness less than the wall thicknesses of the nose and tail. Further, the plastics sleeve encompassing the intermediate part has an outer dimension greater than the outer dimensions of the nose and tail. As a result, there is absolutely no risk of any direct contact between the metal inner part and the guide teeth in the shuttle path and the brake shoes of a catcher brake. This construction can be developed quite simply from a construction of a known all-metal shuttle by grinding out a layer of constant thickness on the outside of the shuttle between a nose part and a tail part and applying a thicker plastics sleeve in the ground-out area.

In another embodiment, wherein the yoke of the yarn clamp is pressed into and retained in the blunt end of the inner part in a press fit, no play can arise in the resulting connection even after prolonged operation, particularly if the connection is strengthened by rivets or securing pins. In this case, the metal parts, i.e. the inner parts and the clamp, form a closed subassembly on which the plastics sleeve can be fitted, and if necessary, given further machining. This feature is advantageous particularly in enabling the plastics sleeve to be narrowed at the front end and adapted to the contours of the nose.

In order to further strengthen the connection between all the parts of the shuttle, at least one rivet is used to secure the inner part, clamp and sleeve together. In this case, the rivet can be introduced through corresponding bores or passages in the plastics sleeve, inner part and clamp. Further, a biased retention of the plastics sleeve between the securing pin and the nose part can be achieved in a similar manner as described in Swiss Pat. No. 571,086.

These and other objects and advantages of the invention will become more apparent when taken in conjunction with the following detailed description and drawings in which:

FIG. 13 illustrates a view taken on line XIII—XIII of FIG. 14; and,

FIG. 14 illustrates a view of a further modified gripper shuttle in accordance with the invention.

Figure 1:
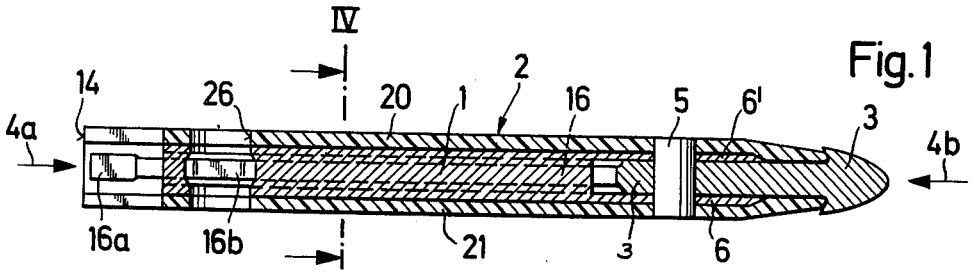
FIG. 1 illustrates a cross-sectional view of a gripper shuttle according to the invention.
Figure 4:
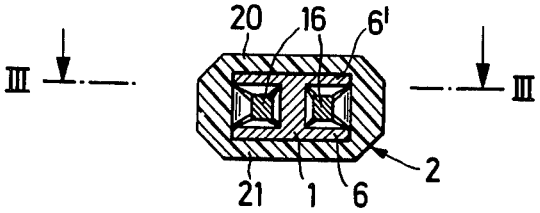
FIG. 4 illustrates a view taken on line IV—IV of FIG. 1.

Referring to FIGS. 1 and 4, the gripper shuttle is composed of a metal inner part 1 in the form of a steel member of I-shaped cross section, a plastics sleeve 2 and a yarn clamp 3. The plastics sleeve 2 is disposed on the metal part 1 in locked relation and has a pair of opposed wide sidewalls 20, 21 and a pair of opposed narrow sidewalls (FIG. 4). The metal inner part 1 has a top flange 6 and a bottom flange 6′ which form opposed external surfaces which extend over the entire internal width of the wide sidewalls 20, 21 of the sleeve 2 and allow bearing of the sidewalls 20, 21 substantially throughout the entire length thereof on the flanges 6, 6′. The inner part 1 also has a web which extends longitudinally along the central axis of the shuttle between two resilient weft clamp arms 16 of the yarn clamp 3 so as not to impede the free movement of the arms 16. The web of the inner part 1 is also recessed at a front end so that the inner part 1 receives a yoke of the yarn clamp 3. As shown, the yoke is retained by a press fit between the tongue-like flanges 6, 6′. The yoke also forms a nose which projects from a forward end of the plastics sleeve 2 while interconnecting the arms 16. The two tongue-like front ends of the flanges 6, 6′ bear on one another via the yoke in this recessed region of the inner part 1.

The two clamping arms 16 have jaws 16*a* which, when closed, clamp a weft yarn end 23 therebetween. The jaws 16*a* are pressed against each other by the resilience of the arms 16 at the rear free ends of the arms 16. The arms 16 are also formed with thickened parts 16*b* which are aligned with passages 26 in the wide sidewalls 20, 21 of the sleeve 2 so as to permit placement of a wedge-shaped or conical clamp opener (not shown) therein in order to open the clamp.

In order to assemble the shuttle, the inner part 1 is first introduced into the sleeve 2 from the rear (arrow 4*a*), whereafter, the clamp 3 is introduced from the front (arrow 4*b*), so that the jaws 16*a* are still just protected by the tail 14 of the shuttle, i.e. the end which is struck by a picking stick (not shown) of the weaving machine. The front end of the sleeve 2 is thus disposed adjacent to the struck surfaces of the nose 3′. Further, the surfaces of the nose 3′ are rearwardly inclined in order to have a barbed effect. The front end of the sleeve 2 tapers and is overlapped by the struck surfaces of the nose 3′.

The cross section of the sleeve 2 is larger all around than the cross section of the nose 3′ so as to preclude any metal-to-metal contact between the nose 3′ and the guide teeth (not shown) of a shuttle guide.

A continuous pin is used to locate the inner part 1, sleeve 2 and the yoke of the yarn clamp 3 relative to one another.

Figure 2:
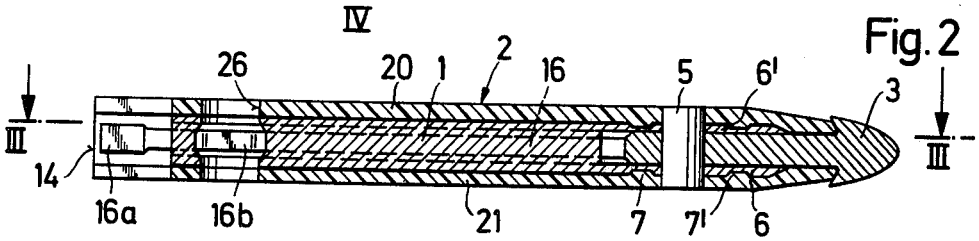
FIG. 2 illustrates a view taken on line II—II of FIG. 3 of a slightly modified gripper shuttle in accordance with the invention.
Figure 3:
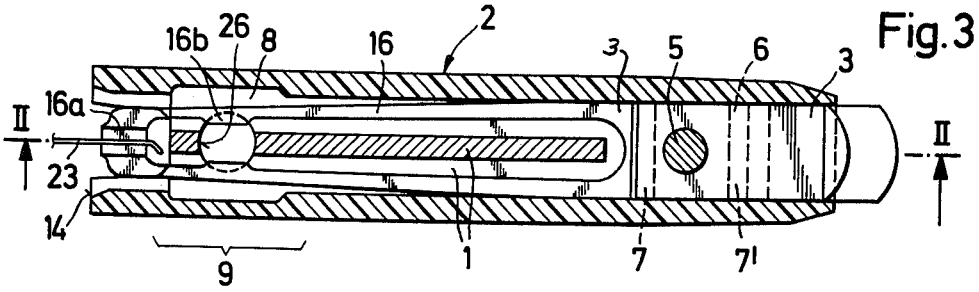
FIG. 3 illustrates a view taken on line III—III of FIG. 2.

Referring to FIGS. 2 and 3, wherein like reference characters indicate like parts as above, the flanges 6, 6′ of the inner part 1 are formed with groove-like recesses while the inside wall of the sleeve 2 is formed with projections such as beads 7, 7′ which match the recesses. Upon introduction of the inner part 1 into the sleeve 2 the projections 7, 7′ snap into the recesses to further strengthen the connection between the inner part 1 and the sleeve 2. A further snap connection between the inner part 1 and the sleeve 2 is provided in the form of a slight widening 8 of the flanges 6, 6′. This widening cooperates with corresponding groove-like recesses in the inside of the narrow sidewalls of the sleeve 2 in the region 9 as indicated in FIG. 3.

Figure 5:
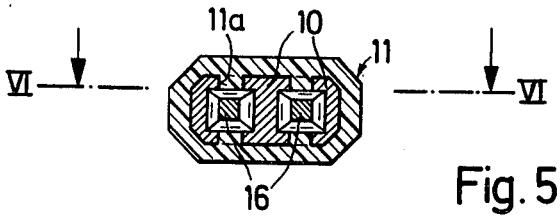
FIG. 5 illustrates a view taken on line V—V of FIG. 6.
Figure 6:
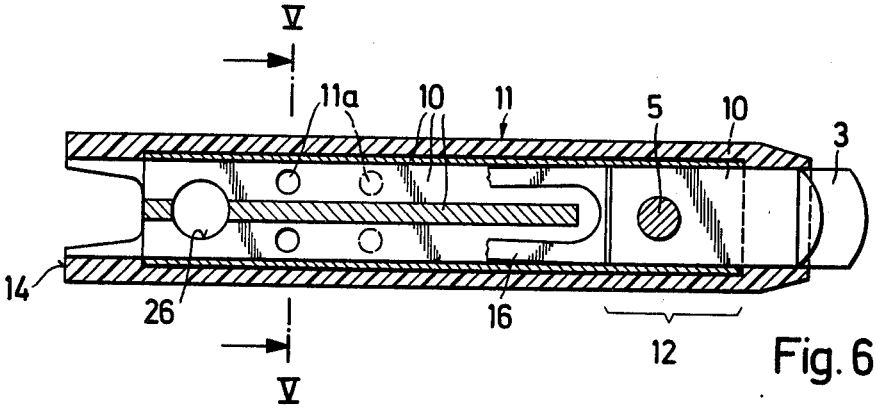
FIG. 6 illustrates a cross-sectional view through a modified gripper shuttle in accordance with the invention as taken on line VI—VI of FIG. 5.
Figure 7:
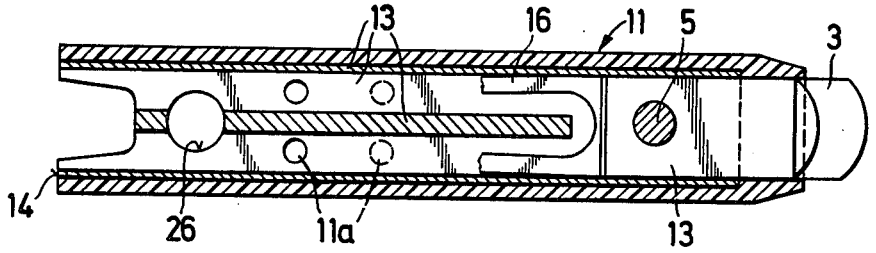
FIG. 7 illustrates a view similar to FIG. 6 of a further modified gripper shuttle in accordance with the invention.

Referring to FIGS. 5 to 7, wherein like reference characters indicate like parts as above, the inner part 10 is in the form of a tubular sleeve of rectangular cross section. In addition, the inner part 10 is stiffened by a partition which extends longitudinally of and between the resilient arms 16 of the clamp 3 in order to strengthen the tubular sleeve. As shown, the partition interconnects the wider sidewalls of the sleeve and forms an integral part of the sleeve 10.

For an easier understanding of the inner part 10, the clamp arms 16 are indicated only by their extensions from the yoke; the free ends of the arms are exactly the same as shown in FIG. 3.

The plastics sleeve 11 is in the form of an extruded article. To this end, the yarn clamp 3 is first secured in a region 12 of the inner part 10 and, thereafter, a plastics composition is extruded around the whole subassembly under pressure by means of a mold device of suitable construction. In order to anchor the sleeve 11 to the inner part 10, at least one sidewall of the inner part 10 is formed with a continuous bore or blind recess 11*a* which fills up with the plastics composition during extrusion. This allows a strong connection between the plastics sleeve 11 and the inner part 10 (see FIG. 5).

As shown in FIG. 6, the inner part 10 does not continue as far as the rear end of the shuttle. Thus, the surface 14 which is struck by a picking stick is entirely made of plastics.

Alternatively, as shown in FIG. 7, wherein like reference characters indicate like parts as above, the inner part 13, which is otherwise identical to the inner part 10 of FIG. 6, extends as far as the struck surface 14 and receives some of the picking energy. Preference between the shuttles of FIG. 6 and FIG. 7 depends upon existing production and operating conditions.

Externally, so far as dimensions and the material used for the surfaces are concerned, there is no difference between the embodiments shown in FIGS. 1 to 4 and the embodiments shown in FIGS. 5 to 7. The only difference resides in their internal construction, their weight, and therefore their operating behavior.

Figure 8:
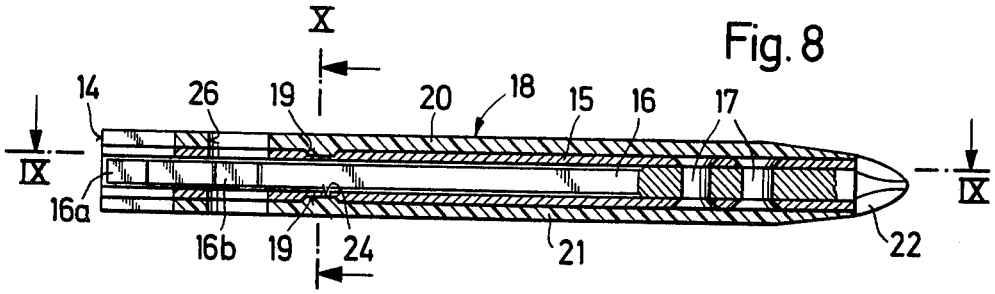
FIG. 8 illustrates a view taken on line VIII—VIII of FIG. 9 of a further embodiment of a gripper shuttle according to the invention.
Figure 9:
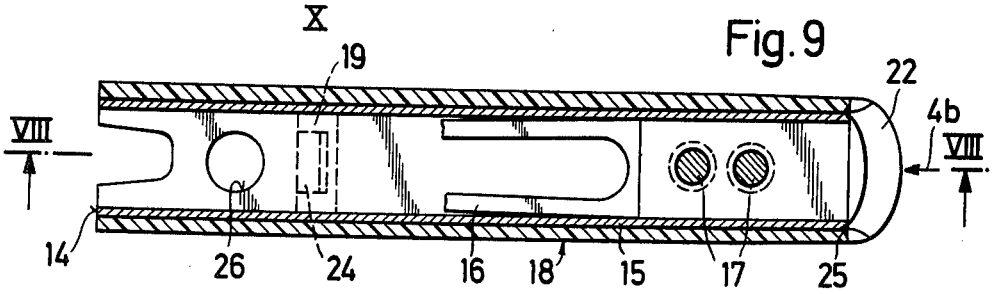
FIG. 9 illustrates a view taken on line IX—IX of FIG. 8.

Referring to FIGS. 8 and 9, the gripper shuttle can be constructed with a plastics sleeve 18 which is made of known shrink material. In this case, the sleeve 18 is originally made as a plastics tube which contracts when heated or which, like the material called Mylar, expands when introduced into an appropriate liquid, for example toluene, and can be pushed on to the metal inner part 15 while in the expanded state. After evaporation of the liquid which is taken up, a plastics tube or material of this kind contracts to the original dimensions.

As shown in FIGS. 8 and 9, the metal inner part 15 is in the form of a smooth tubular sleeve of rectangular cross section which has no partition and which extends over the whole length of the shuttle from the surface 14 to the nose 22. In this case, the yoke of the yarn clamp is unitary with the nose 22 and upon assembly is welded, for example, electronically, along a weld seam 25 to the front opening of the inner part 15. The yoke may also be secured to the inner part 15 by means of one or more countersunk rivets 17. In this construction, the plastics sleeve 18 tapers slightly at the front end and the nose cross section is smaller than the cross section of the plastics sleeve 18.

Figure 12:
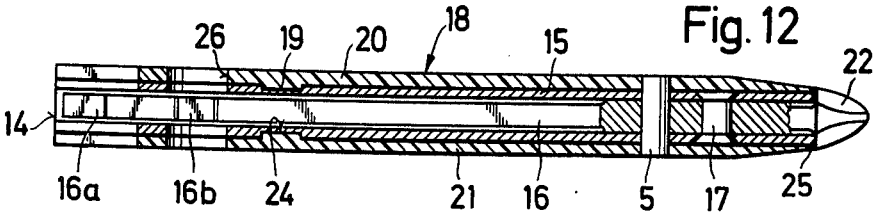
FIG. 12 illustrates a cross-sectional view of a further modified gripper shuttle in accordance with the invention.

Alternatively, as shown in FIG. 12, wherein like reference characters indicate like parts as above, a securing pin 5 is provided to enable the front part of the sleeve 18 to be assembled with a bias between the pin 5 and the nose 22.

Figure 10:
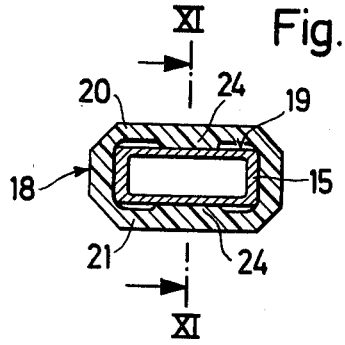
FIG. 10 illustrates a view taken on line X—X of FIG. 8.
Figure 11:
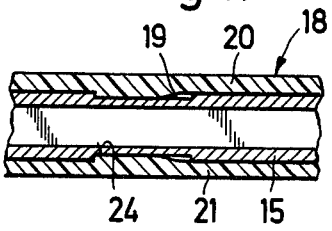
FIG. 11 illustrates a modified arrangement of matching projections and recesses between an inner part and a plastics sleeve of a gripper shuttle in accordance with the invention.

Referring to FIGS. 8, 10 and 11, a snap connection is formed between the metal inner part 15 and the plastics sleeve 18. This snap connection is formed by a shallow groove or the like 19 in the outside surface of the inner part 15 transversely of the shuttle path and by a correspondingly shaped widened projection 24 on the inside of the plastics sleeve 18. As indicated in FIG. 10, the projection 24 is received in the groove 19 with a slight biasing. Referring to FIG. 11, the right-hand edge of the projection 24 is bevelled while the left-hand edge, as viewed, is a dead right angle. The bevelling of the right-hand edge facilitates drawing on of the plastics sleeve 18 and the snap fit engagement of the projection 24 in the groove 19 once the final position has been reached.

Referring to FIGS. 13 and 14, the gripper shuttle may be provided with a metal inner part 27, 28, 29 which is initially in the form of a tube constant rectangular cross section. As shown, the tube extends over the whole length of the shuttle, and includes a nose 27, an intermediate part 28 and a tail 29. As shown, the front of the intermediate part is closed by the nose 27 and is either welded to the intermediate part 28 or is integral therewith. The rear end of the intermediate part 28 merges into the tail 29 which has a surface 14 adapted to be struck by a picking stick. As shown in FIG. 13, the intermediate part which extends between the nose 27 and the tail 29 is of a wall thickness less than the wall thickness of the nose 27 and the tail 29. Further, a plastics sleeve 32 encompasses the intermediate part 28 and has an outer dimension greater than the outer dimensions of the nose 27 and the tail 29.

In the case where the metal inner part is formed of a uniform thickness, a groove to accommodate the plastics sleeve 32 can be formed, for example, by grinding a circumferential recess from a front edge 34 adjacent the nose 27 to a back edge 33 adjacent the tail 29. The peripheral groove which is thus formed is then filled up or covered by the plastics sleeve 32.

The plastics sleeve 32 can be formed in any known manner, such as by being extruded about the intermediate part 28 or by being secured in a press fit in an eddying sintering process or by being adhesively secured to the intermediate part 28. The two edges 33, 34 of the intermediate part 28 prevent any longitudinal displacement of the plastics sleeve 28. The clamp arms 30, 30' are connected to each other by a yoke 35 which is pressed into the region 12 of the inner part. As shown, the plastics sleeve 32, intermediate part 28 and clamping yoke 35 are additionally rigidly kept together by rivets 31. Also, the surface of the plastics sleeve 32 is reworked at the front end and has a slightly tapered cross section so as to pass over the surface of the nose 27 at 34; the outer cross section of the nose 27 is smaller than that of the plastics sleeve 32.

The invention is not restricted to the embodiments described. On the contrary, further constructions are conceivable, especially combinations with known characteristics which are advantageous for certain operational conditions, such as longevity, cleanliness of the web, small number of thread losses, the weft order and weft speed, etc.

What is claimed is:

1. A gripper shuttle for picking in a weaving machine comprising a metal inner part having a pair of opposed external surfaces;

a plastics sleeve disposed about said metal inner part in locked relation and having a pair of opposed wide sidewalls bearing substantially throughout the entire length thereof on said external surfaces of said inner part and a pair of opposed narrow sidewalls, said wide sidewalls having outer sliding surfaces for sliding on a series of guide teeth during picking and for engagement by a catcher during braking; and a yarn clamp having a pair of resilient arms disposed within said inner part for engaging a yarn.

2. A gripper shuttle as set forth in claim 1 wherein said inner part is of I-shaped cross section with a web extending longitudinally of said sleeve between said resilient arms.

3. A gripper shuttle as set forth in claim 1 wherein said inner part is a tubular sleeve of rectangular cross section with said resilient arms disposed therein.

4. A gripper shuttle as set forth in claim 3 wherein said inner part has a partition extending longitudinally of and between said resilient arms for strengthening said tubular sleeve.

5. A gripper shuttle as set forth in claim 3 wherein said inner part extends to a rear end of said sleeve.

6. A gripper shuttle as set forth in claim 1 wherein said yarn clamp has a yoke interconnecting said arms and forming a nose projecting from a forward end of said sleeve.

7. A gripper shuttle as set forth in claim 6 which further comprises a weld seam securing said nose and said inner part together.

8. A gripper shuttle as set forth in claim 1 wherein said inner part projects from a forward end of said sleeve to form a nose.

9. A gripper shuttle as set forth in claim 1 wherein said inner part is press fit into said sleeve.

10. A gripper shuttle as set forth in claim 9 which further comprises a plurality of respective mating projections and recesses in said inner part and said sleeve for interlocking said inner part and said sleeve together.

11. A gripper shuttle as set forth in claim 10 wherein said sleeve is extrudably mounted about said inner part.

12. A gripper shuttle as set forth in claim 1 wherein said inner part has a nose projecting from a forward end of said sleeve, a tail projecting from a rear end of said sleeve, and an intermediate part between said nose and said tail of a wall thickness less than the wall thicknesses of said nose and said tail, and wherein said sleeve encompasses said intermediate part and has an outer dimension greater than the outer dimensions of said nose and said tail.

13. A gripper shuttle as set forth in claim 1 wherein said yarn clamp has a yoke interconnecting said arms and press fit into said inner part.

14. A gripper shuttle as set forth in claim 1 wherein said yarn clamp has a yoke interconnecting said arms and which further comprises at least one rivet securing said yoke to said inner part.

15. A gripper shuttle as set forth in claim 1 further comprising at least one rivet securing said inner part, clamp and sleeve together.

16. A gripper shuttle for picking in a weaving machine comprising a metal tubular sleeve of rectangular cross-section;

a plastics sleeve disposed about said metal sleeve and having a pair of opposed wide sidewalls bearing on said metal sleeve and a pair of opposed narrow sidewalls, said wide sidewalls having outer sliding surfaces for sliding on a series of guide teeth during picking and for engagement by a catcher during braking; and a yarn clamp having a pair of resilient arms disposed within said metal sleeve for engaging a yarn.

17. A gripper shuttle as set forth in claim 16 wherein said metal sleeve has a partition extending longitudinally of and between said resilient arms for strengthening said metal sleeve.

18. A gripper shuttle as set forth in claim 16 wherein said metal sleeve extends to a rear end of said plastics sleeve.

19. A gripper shuttle for picking in a weaving machine comprising a metal inner part;

a plastics sleeve disposed about said metal inner part and having a pair of opposed wide sidewalls bearing on said inner part and a pair of opposed narrow sidewalls, said wide sidewalls having outer sliding surfaces for sliding on a series of guide teeth during picking and for engagement by a catcher during braking;

a yarn clamp having a pair of resilient arms disposed within said inner part for engaging a yarn and a yoke interconnecting said arms and forming a nose projecting from a forward end of said sleeve; and a weld seam securing said nose and said inner part together.

20. A gripper shuttle for picking in a weaving machine comprising a metal inner part;

a plastics sleeve disposed about said metal inner part with said inner part projecting from a forward end of said sleeve to form a nose, said sleeve having a pair of opposed wide sidewalls bearing on said inner part and a pair of opposed narrow sidewalls, said wide sidewalls having outer sliding surfaces for sliding on a series of guide teeth during picking and for engagement by a catcher during braking; and a yarn clamp having a pair of resilient arms disposed within said inner part for engaging a yarn.

21. A gripper shuttle as set forth in claim 20 wherein said inner part has a tail projecting from a rear end of said sleeve, and an intermediate part between said nose and said tail of a wall thickness less than the wall thicknesses of said nose and said tail, and wherein said sleeve encompasses said intermediate part and has an outer dimension greater than the outer dimensions of said nose and said tail.

22. A gripper shuttle for picking in a weaving machine comprising a metal inner part;

a plastics sleeve extrudably mounted about said metal inner part with said inner part press fit into said sleeve, said sleeve having a pair of opposed wide sidewalls bearing on said inner part and a pair of opposed narrow sidewalls, said wide sidewalls having outer sliding surfaces for sliding on a series of guide teeth during picking and for engagement by a catcher during braking;

a yarn clamp having a pair of resilient arms disposed within said inner part for engaging a yarn; and a plurality of respective mating projections and recesses in said inner part and said sleeve for interlocking said inner part and said sleeve together.

23. A gripper shuttle for picking in a weaving maching comprising a metal inner part;

a plastics sleeve disposed about said metal inner part and having a pair of opposed wide sidewalls bearing on said inner part and a pair of opposed narrow sidewalls, said wide sidewalls having outer sliding surfaces for sliding on a series of guide teeth during picking and for engagement by a catcher during braking; and, a yarn clamp having a pair of resilient arms disposed within said inner part for engaging a yarn; and a yoke interconnecting said arms and press fit into said inner part.

24. A gripper shuttle for picking in a weaving machine comprising a metal inner part;

a plastics sleeve disposed about said metal inner part and having a pair of opposed wide sidewalls bearing on said inner part and a pair of opposed narrow sidewalls, said wide sidewalls having outer sliding surfaces for sliding on a series of guide teeth during picking and for engagement by a catcher during braking;

a yarn clamp having a pair of resilient arms disposed within said inner part for engaging a yarn; and a yoke interconnecting said arms; and at least one rivet securing said yoke to said inner part.

25. A gripper shuttle for picking in a weaving machine comprising a metal inner part;

a plastics sleeve disposed about said metal inner part and having a pair of opposed wide sidewalls bearing on said inner part and a pair of opposed narrow sidewalls, said wide sidewalls having outer sliding surfaces for sliding on a series of guide teeth during picking and for engagement by a catcher during braking;

a yarn clamp having a pair of resilient arms disposed within said inner part for engaging a yarn; and at least one rivet securing said inner part, clamp and sleeve together.

* * * * *

UNITED STATES PATENT AND TRADEMARK OFFICE

CERTIFICATE OF CORRECTION

PATENT NO. : 4,120,329

DATED : October 17, 1978

INVENTOR(S) : Otto Hintsch and Rudolf Stauner

It is certified that error appears in the above-identified patent and that said Letters Patent are hereby corrected as shown below:

Column 1, line 17, change "3,339,818" to --3,339,878--

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*